US009799432B2

(12) United States Patent
Yamaguchi et al.

(10) Patent No.: US 9,799,432 B2
(45) Date of Patent: Oct. 24, 2017

(54) GRAIN ORIENTED ELECTRICAL STEEL SHEET

(75) Inventors: Hiroi Yamaguchi, Tokyo (JP); Seiji Okabe, Tokyo (JP); Takeshi Omura, Tokyo (JP); Tadashi Nakanishi, Tokyo (JP)

(73) Assignee: JFE Steel Corporation (JP)

( * ) Notice: Subject to any disclaimer, the term of this patent is extended or adjusted under 35 U.S.C. 154(b) by 363 days.

(21) Appl. No.: 13/814,629

(22) PCT Filed: Aug. 4, 2011

(86) PCT No.: PCT/JP2011/004448
§ 371 (c)(1),
(2), (4) Date: Feb. 6, 2013

(87) PCT Pub. No.: WO2012/017675
PCT Pub. Date: Feb. 9, 2012

(65) Prior Publication Data

US 2013/0133783 A1 May 30, 2013

(30) Foreign Application Priority Data

Aug. 6, 2010 (JP) ..... 2010-177629

(51) Int. Cl.

| | |
|---|---|
| ***H01F 1/16*** | (2006.01) |
| ***H01F 1/01*** | (2006.01) |
| ***C21D 8/12*** | (2006.01) |
| ***C22C 38/00*** | (2006.01) |
| ***C22C 38/04*** | (2006.01) |
| ***C22C 38/34*** | (2006.01) |
| *C22C 38/02* | (2006.01) |

(52) U.S. Cl.
CPC ..... *H01F 1/01* (2013.01); *C21D 8/1261* (2013.01); *C21D 8/1283* (2013.01); *C21D 8/1288* (2013.01); *C21D 8/1294* (2013.01); *C22C 38/00* (2013.01); *C22C 38/04* (2013.01); *C22C 38/34* (2013.01); *H01F 1/16* (2013.01); *C21D 2201/05* (2013.01); *C22C 38/02* (2013.01)

(58) Field of Classification Search
CPC ..... C22C 38/00; C22C 38/60; C21D 8/12; H01F 1/16
See application file for complete search history.

(56) References Cited

U.S. PATENT DOCUMENTS

| | | | | |
|---|---|---|---|---|
| 4,293,350 A | * | 10/1981 | Ichiyama et al. | 148/111 |
| 5,411,604 A | | 5/1995 | Inokuti et al. | |
| 2001/0032684 A1 | | 10/2001 | Sakai et al. | |
| 2006/0169362 A1 | | 8/2006 | Sakai et al. | |

FOREIGN PATENT DOCUMENTS

| | | | | |
|---|---|---|---|---|
| CN | 1331348 A | | 1/2002 | |
| CN | 1359113 A | | 7/2002 | |
| EP | 0 260 927 | | 3/1988 | |
| JP | 57-2252 | | 1/1982 | |
| JP | 63-83227 | | 4/1988 | |
| JP | 64-68425 | | 3/1989 | |
| JP | 01068425 A | * | 3/1989 | C21D 8/12 |
| JP | 2-22423 | | 1/1990 | |
| JP | 02022423 A | * | 1/1990 | C21D 8/12 |
| JP | 03-260020 | | 11/1991 | |
| JP | 05-43944 | | 2/1993 | |
| JP | 05-43945 | | 2/1993 | |

(Continued)

OTHER PUBLICATIONS

Note regarding Foreign Patent Documents N and O: JP 01068425 A and JP 02022423 A were cited in IDS dated Feb. 6, 2013.*
English Machine Translation of JP01-068425A of Iguchi published in Mar. 1989.*
English Machine Translation ofJP02-022423A of Iguchi et al. published in Jan. 1990.*
English Machine Translation of JP 02-022423A of Iguchi et al. published in Jan. 1990.*
English Machine Translation of JP 01-068425 A of Iguchi et al. published in Mar. 1989.*
Japanese Notification of Reasons for Refusal dated Aug. 19, 2014 along with an English translation for corresponding Japanese Patent Application No. 2010-177629. Chinese Official Action dated May 5, 2014 from corresponding Chinese Patent Application No. 201180038909.0 along with English translation.
Corresponding Office Action dated Jan. 16, 2015 of Chinese Application No. 201180038909.0 with English translation.
Chinese Office Action dated Jul. 21, 2015 of corresponding Chinese Application No. 201180038909.0 along with an English translation.
Japanese Office Action dated Dec. 22, 2015 of corresponding Japanese Application No. 2010-177629 along with a Concise Statement of Relevance of Office Action in English.
Japanese Office Action dated Mar. 29, 2016, of corresponding Japanese Application No. 2010-177629, along with a Concise Statement of Relevance of Office Action in English.
European Search Report dated May 2, 2017 of corresponding European Application No. 11814310.6.

*Primary Examiner* — Roy King
*Assistant Examiner* — Jophy S Koshy
(74) *Attorney, Agent, or Firm* — DLA Piper LLP (US)

(57) ABSTRACT

A grain oriented electrical steel sheet has a magnetic domain structure modified by strain introduction without a trace of treatment, in which noise generated when the grain oriented electrical steel sheet is used laminated on an iron core of a transformer is effectively reduced by: setting a magnetic flux density $B_8$ to 1.92 T or higher; then setting a ratio of average magnetic domain width of treated surface after strain-introducing treatment $W_a$ to average magnetic domain width before strain-introducing treatment $W_0$ as $W_a/W_0<0.4$; and setting a ratio of $W_a$ to average magnetic domain width of untreated surface $W_b$ as $W_a/W_b>0.7$; and further setting a ratio of average width of magnetic domain discontinuous portion $W_d$ in the untreated surface to average width of magnetic domain discontinuous portion in treated surface resulting from strain-introducing treatment $W_c$ as $W_d/W_c>0.8$; and setting $W_c<0.35$ mm.

5 Claims, 1 Drawing Sheet

(56) References Cited

FOREIGN PATENT DOCUMENTS

| | | |
|---|---|---|
| JP | 05-51645 | 3/1993 |
| JP | 05-65543 | 3/1993 |
| JP | 05-179355 | 7/1993 |
| JP | 5-311241 | 11/1993 |
| JP | 05-335128 | 12/1993 |
| JP | 06-2042 | 1/1994 |
| JP | 6-72266 | 9/1994 |
| JP | 2000328139 | 11/2000 |
| JP | 2002-12918 | 1/2002 |
| WO | 2004/083465 A1 | 9/2004 |

* cited by examiner

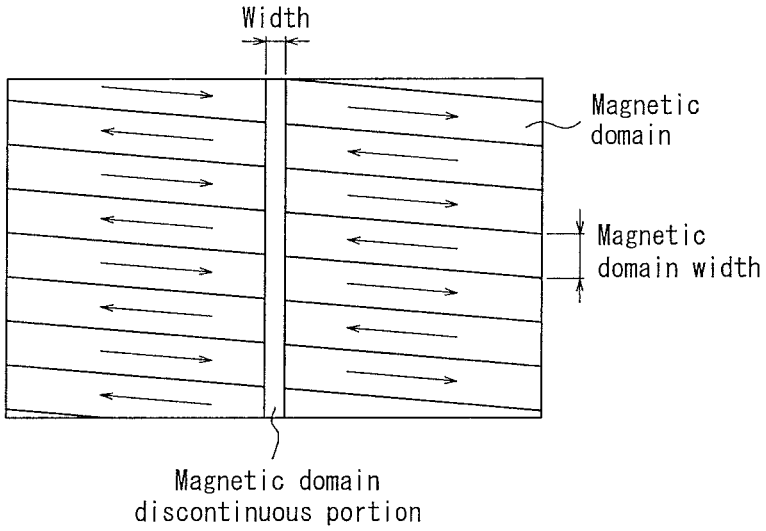
Width
Magnetic domain
Magnetic domain width
Magnetic domain discontinuous portion

GRAIN ORIENTED ELECTRICAL STEEL SHEET

RELATED APPLICATIONS

This is a 371 of International Application No. PCT/JP2011/004448, with an international filing date of Aug. 4, 2011 (WO 2012/017675 A1, published Feb. 9, 2012), which is based on Japanese Patent Application No. 2010-177629 filed Aug. 6, 2010, the subject matter of which is incorporated herein by reference.

TECHNICAL FIELD

This disclosure relates to a grain oriented electrical steel sheet that exhibits excellent noise properties and preferably used for the material of iron cores of transformers.

BACKGROUND

Grain oriented electrical steel sheets mainly used as iron cores of transformers are required to have excellent magnetic properties, in particular, less iron loss. To meet this requirement, it is important that secondary recrystallized grains are highly aligned in the steel sheet in the (110)[001] orientation (or the Goss orientation) and impurities in the product are reduced.

However, there are limitations on controlling crystal orientation and reduce impurities in terms of balancing with manufacturing cost, and so on. Therefore, some techniques have been developed for introducing non-uniformity to the surfaces of a steel sheet in a physical manner to reduce the magnetic domain width for less iron loss, namely, magnetic domain refining techniques. For example, JP 57-002252 B proposes a technique for reducing iron loss by irradiating a final product steel sheet with a laser, introducing a linear, high dislocation density region to the surface layer of the steel sheet and thereby reducing the magnetic domain width.

In addition, JP 06-072266 B proposes a technique for controlling the magnetic domain width by electron beam irradiation. In that method for reducing iron loss by electron beam irradiation, electron beam scanning can be performed at a high rate by controlling magnetic fields. In that method, there is no mechanically movable part as found in an optical scanning mechanism used in laser application. This is particularly advantageous when irradiating a series of wide strips, each having a width of 1 m or more, with an electron beam continuously at high rate.

However, even such a grain oriented electrical steel sheet that has been subjected to the magnetic domain refining treatment as described above may produce significant noise when assembled into an actual transformer.

It could therefore be helpful to provide a grain oriented electrical steel sheet with reduced iron loss by magnetic domain refinement treatment that exhibits excellent noise properties and may effectively reduce noise generated when used laminated on an iron core of a transformer.

SUMMARY

We thus provide:

[1] A grain oriented electrical steel sheet having a magnetic flux density $B_8$ of 1.92 T or higher and having a magnetic domain structure modified by strain introduction without a trace of treatment, wherein a ratio of an average magnetic domain width in a treated surface after strain-introducing treatment $W_a$ to an average magnetic domain width before the strain-introducing treatment $W_0$ is $W_a/W_0<0.4$, and a ratio of the average magnetic domain width $W_a$ to an average magnetic domain width in an untreated surface $W_b$ is $W_a/W_b>0.7$, wherein a ratio of an average width of a magnetic domain discontinuous portion in the untreated surface $W_d$ to an average width of a magnetic domain discontinuous portion in the treated surface resulting from the strain-introducing treatment $W_c$ is $W_d/W_c>0.8$, and $W_c<0.35$ mm.

[2] The grain oriented electrical steel sheet according to item [1] above, wherein the strain-introducing treatment is electron beam irradiation.

[3] The grain oriented electrical steel sheet according to item [1] above, wherein the strain-introducing treatment is continuous laser irradiation.

A grain oriented electrical steel sheet with reduced iron loss by strain introduction may produce less noise when laminated into a transformer as compared with the conventional techniques.

BRIEF DESCRIPTION OF THE DRAWINGS

Our steel sheets will be further described below with reference to the accompanying drawing, wherein:

FIG. 1 illustrates the results of observing magnetic domains in a surface of the steel sheet.

DETAILED DESCRIPTION

It is known that the noise of a transformer is caused by the magnetostrictive behavior occurring when an electrical steel sheet is magnetized. For example, an electrical steel sheet containing about 3 mass % of Si is generally elongated along its magnetization direction. Thus, when excited by alternating current, the steel sheet undergoes alternating magnetization varying the sign of magnetization between positive and negative around zero, and as a result, the iron core repeatedly expands and contracts, which causes noise.

Since magnetostrictive vibration corresponds to the positive and negative signs of magnetization, the steel sheet will oscillate at a period twice the frequency of the alternating current excitation. When the steel sheet is excited at 50 Hz, the fundamental vibration frequency of the magnetostrictive vibration will be 100 Hz. However, analysis of the frequency of transformer noise shows that transformer noise contains many high-harmonic components. In many cases, the frequency components of around 200 Hz to 700 Hz are stronger than the frequency component of 100 Hz of the fundamental frequency and thus determine the absolute value of noise. Such high-harmonic components are caused by various, extremely complicated factors including mechanical vibration depending on the shape of the iron core, vibration of a jig for holding the laminated iron core, and so on.

In addition to such high-harmonic components of the fundamental vibration frequency, with respect to the magnetostrictive vibration of the steel sheet itself, the observed magnetostrictive vibration contains high-harmonic components at other than 100 Hz of the fundamental frequency even if the steel sheet is excited with a sinusoidal wave at 50 Hz, for example. It is believed that this is ascribed to a change in the magnetic domain structure responsible for the magnetization process of a soft magnetic material.

Accordingly, we analyzed the behavior of magnetostrictive vibration, focusing on the magnetic domain structure of the grain oriented electrical steel sheet, one side of which had been subjected to magnetic domain control treatment using an electron beam irradiation scheme. As a result, we found that from the viewpoint of reducing iron loss, sufficient effects are obtained by applying linear distortion on only one side of the steel sheet. However, with respect to transformer noise, namely, magnetostrictive vibration, it is extremely important that identical magnetic domain refinement effects are obtained on both sides of the steel sheet.

In addition, when the magnetic domain structure was observed from both sides of the steel sheet, found that the magnetic domain width in the untreated surface might not always be the same as that of the treated surface. In view of the foregoing, we examined the relationship between the ratio of the magnetic domain widths observed on both sides of the steel sheet and the frequency component of noise of a model transformer due to the laminated iron core at the time of alternating magnetization of the transformer. As a result, we found that if there is a difference in magnetic domain width between the both sides, there are different magnetization conditions in the sheet thickness direction. This results in complicated movement of magnetic domain walls dividing magnetic domains and, therefore, more high-harmonic components will be superimposed on the excitation frequency in proportion to the complexity of movement of magnetic domain walls. These high-harmonic components become a factor that increases noise because, in particular, they are within the audible band of the noise spectrum. Accordingly, we found that high-harmonic components of the magnetostrictive vibration caused by the movement of magnetic domain walls can be decreased by reducing the difference in magnetic domain width between the both sides of the steel sheet, which results in less noise.

With respect to transformer noise, namely, magnetostrictive vibration, the higher the degree of alignment of crystal grains of the material with the easy axis of magnetization, the smaller the amplitude of oscillation. In particular, for noise reduction, it is effective to set a magnetic flux density $B_8$ to 1.92 T or higher. In this regard, if the magnetic flux density $B_8$ is less than 1.92 T, magnetic domains must perform rotational motion to align parallel to the excitation magnetic field during the magnetization process. Thus, this magnetization rotation causes a large magnetostriction, which increases the noise of a transformer. Therefore, a grain oriented electrical steel sheet having a magnetic flux density $B_8$ of 1.92 T or higher is used.

In addition, the magnetic domain structure is modified by strain introduction. In this strain introduction, however, it is important to leave no traces indicative of the strain being introduced to the treated surface.

The term "grain oriented electrical steel sheet without a trace of treatment" means such an electrical steel sheet whose surface condition is such that the originally-provided tension coating will not be impaired by strain-introducing treatment, i.e., any post-treatment such as recoating will not be required. If the tension coating is locally impaired by strain introduction, the stress distribution originally provided by coating becomes non-uniform and thus the magnetostrictive vibration waveform of the steel sheet is distorted, which induces superimposition of high-harmonic components. Therefore, this is not preferable for noise reduction. It should be noted that if a trace of treatment is present, recoating is performed and the steel sheet is subjected to low temperature firing to avoid cancellation of the introduced strain. Therefore, such recoating neither offer tension effects comparable to those provided before the impairment of the tension coating, nor enough to eliminate non-uniformity in the stress distribution.

With respect to magnetic domain width, an average magnetic domain width before the treatment ($W_0$), an average magnetic domain width in a treated surface after the treatment ($W_a$), and an average magnetic domain width in an untreated surface after the treatment ($W_b$) are calculated by performing a weighted average of the magnetic domain widths of individual crystal grains depending upon the area ratio. In addition, "magnetic domain width" means the width of main magnetic domains parallel to the rolling direction. Accordingly, the measurement of magnetic domain width is performed in a transverse direction (a direction perpendicular to the rolling direction).

In this case, a ratio of the average magnetic domain width after the treatment to the average magnetic domain width before the treatment ($W_a/W_0$) needs to be less than 0.4. If the ratio of the average magnetic domain width after the treatment to the average magnetic domain width before the treatment $W_a/W_0$ is 0.4 or more, the effect of magnetic domain control treatment itself is not enough and iron loss of the steel sheet is not reduced sufficiently.

In addition, the ratio between the average magnetic domain widths on the both sides of the steel sheet ($W_a/W_b$) needs to be more than 0.7. The further the ratio between the magnetic domain widths on the both sides $W_a/W_b$ is below 0.7, the more likely the magnetization conditions will differ in the sheet thickness direction if the magnetic domain width differs between the both sides, even when the steel sheet is excited with a sinusoidal wave without high-harmonic components. This results in generation of high-harmonic components and increased noise of a transformer. In addition, the maximum value of $W_a/W_b$ is about 1.0.

"Average width of a magnetic domain discontinuous portion resulting from the strain-introducing treatment" means the width of a portion where the magnetic domain structure is locally disrupted by strain, typically indicating a portion at which the magnetic domain structure parallel to the rolling direction is disconnected or discontinued. If the ratio of the average width of the magnetic domain discontinuous portion in the untreated surface $W_d$ to the average width of the magnetic domain discontinuous portion in the treated surface $W_c$ does not satisfy a relation of $W_d/W_c>0.8$, i.e., if there is a significant difference between the widths of the discontinuous portions on the both sides, there will be a difference in magnetization conditions in the sheet thickness direction of the steel sheet. This results in a distortion in the magnetostrictive vibration waveform, which also increases the noise of a transformer. Although the upper limit of $W_d/W_c$ does not need to be limited to a particular value, the maximum value thereof is about 3.0. In addition, if $W_c<0.35$ mm is not satisfied, a sufficient iron loss reduction effect cannot be obtained due to the locally disrupted magnetic domain structure.

In any event, to reduce the noise of a transformer, it is effective to introduce strain in the sheet thickness direction in a sufficiently uniform manner, and it is necessary to provide a high magnetic flux density to leave no trace of treatment, to offer a significant effect of reducing the width of magnetic domains and to reduce the difference between the both sides. If any of these conditions are not met, it is not possible to reduce the noise of a transformer sufficiently.

Suitable strain-introducing treatment without a trace of treatment includes, for example, electron beam irradiation, continuous laser irradiation, and so on. Irradiation is preferably performed in a direction transverse to the rolling direction, preferably at 60° to 90° to the rolling direction, and the irradiation interval of the electron beam is preferably about 3 to 15 mm. To achieve sufficient strain introduction as to reach the untreated surface side of the steel sheet without leaving a trace of treatment, in the case of an electron beam, it is preferable to use a large current at a low acceleration voltage, and it is effective to apply the electron beam in a spot-like or linear fashion with an acceleration voltage of 5 to 50 kV, current of 0.5 to 100 mA and beam diameter of 0.01 to 0.5 mm.

On the other hand, in the case of continuous laser, the power density is preferably 100 to 5000 W/mm$^2$ depending on the scanning rate of laser beam. In addition, such a technique is also effective where the power density is kept constant and changed periodically by modulation. Effective excitation sources include a fiber laser excited by semiconductor laser, and so on. In particular, if the beam diameter of the laser is reduced to about 0.02 mm, and when irradiation is performed in dashed-line form, i.e., in the form of a continuous line interrupted at a constant interval, a reduction in the area of the strain-introduced portion due to the reduced diameter can be compensated for in the form of lines rather than points. This small beam diameter allows for reduction in the widths $W_c$ and $W_d$ of the magnetic domain discontinuous portions as well as the difference therebetween and, furthermore, reduction in the magnetic domain widths $W_a$ and $W_b$ as well as the difference therebetween.

For example, since a Q-switch type pulse laser leaves a trace of treatment, the locally-impaired coating tension leads to non-uniform magnetostrictive vibration. In addition, while plasma jet irradiation leaves no trace of treatment, this causes a larger difference in magnetic domain width and magnetic domain discontinuous portion width between the treated surface and the untreated surface, which is difficult to reduce within the preferred range of the present invention.

The magnetic domain width of the treated surface may be primarily adjusted by controlling the intensity of irradiation energy. In addition, the difference in magnetic domain width between the treated surface and the untreated surface may be adjusted by controlling the distribution of irradiation energy density. That is, this difference may be adjusted by controlling the depth and range of incidental energy, while switching between in- and out-of focus through beam focus adjustment. Similarly, the magnetic domain discontinuous portion width of the treated surface and the magnetic domain discontinuous portion width of the untreated surface may also be adjusted by controlling the depth and range of incidental energy, while controlling the intensity of irradiation energy, performing focus adjustment, and so on.

Next, the conditions of manufacturing a grain oriented electrical steel sheet according to the present invention will be specifically described below. A slab for a grain oriented electrical steel sheet may have any chemical composition that allows for secondary recrystallization.

In addition, if an inhibitor, e.g., an AlN-based inhibitor is used, Al and N may be contained in an appropriate amount, respectively, whereas if a MnS/MnSe-based inhibitor is used, Mn and Se and/or S may be contained in an appropriate amount, respectively. Of course, these inhibitors may also be used in combination. In this case, preferred contents of Al, N, S and Se are: Al: 0.01 to 0.065 mass %; N: 0.005 to 0.012 mass %; S: 0.005 to 0.03 mass %; and Se: 0.005 to 0.03 mass %, respectively.

The grain oriented electrical steel sheet may have limited contents of Al, N, S and Se without using an inhibitor. In that case, the amounts of Al, N, S and Se are preferably: Al: 100 mass ppm or less: N: 50 mass ppm or less; S: 50 mass ppm or less; and Se: 50 mass ppm or less, respectively.

The basic elements and other optionally added elements of the slab for a grain oriented electrical steel sheet will be specifically described below.

<C: 0.08 Mass % or Less>

C is added to improve the texture of a hot-rolled sheet. However, C content exceeding 0.08 mass % increases the burden to reduce C content to 50 mass ppm or less where magnetic aging will not occur during the manufacturing process. Thus, C content is preferably 0.08 mass % or less. Besides, it is not necessary to set up a particular lower limit to C content because secondary recrystallization is enabled by a material without containing C.

<Si: 2.0 to 8.0 Mass %>

Si is an element useful to increase electrical resistance of steel and improve iron loss. Si content of 2.0 mass % or more has a particularly good effect in reducing iron loss. On the other hand, Si content of 8.0 mass % or less may offer particularly good formability and magnetic flux density. Thus, Si content is preferably 2.0 to 8.0 mass %.

<Mn: 0.005 to 1.0 Mass %>

Mn is an element necessary to improve hot formability. However, Mn content less than 0.005 mass % has a less addition effect. On the other hand, Mn content of 1.0 mass % or less provides a particularly good magnetic flux density to the product sheet. Thus, Mn content is preferably 0.005 to 1.0 mass %.

Further, in addition to the above elements, the slab may also contain the following elements as elements to improve magnetic properties:

at least one element selected from: Ni: 0.03 to 1.50 mass %; Sn: 0.01 to 1.50 mass %; Sb: 0.005 to 1.50 mass %; Cu: 0.03 to 3.0 mass %; P: 0.03 to 0.50 mass %; Mo: 0.005 to 0.10 mass %; and Cr: 0.03 to 1.50 mass %.

Ni is an element useful to further improve the texture of a hot-rolled sheet to obtain even more improved magnetic properties. However, Ni content of less than 0.03 mass % is less effective in improving magnetic properties, whereas Ni content of 1.5 mass % or less increases, in particular, the stability of secondary recrystallization and provides even more improved magnetic properties. Thus, Ni content is preferably 0.03 to 1.5 mass %.

In addition, Sn, Sb, Cu, P, Mo and Cr are elements useful to improve the magnetic properties, respectively. However, if any of these elements is contained in an amount less than its lower limit described above, it is less effective in improving the magnetic properties, whereas if contained in an amount equal to or less than its upper limit described above, it gives the best growth of secondary recrystallized grains. Thus, each of these elements is preferably contained in an amount within the above-described range.

The balance other than the above-described elements is preferably Fe and incidental impurities that are incorporated during the manufacturing process.

Then, the slab having the above-described chemical composition is subjected to heating before hot rolling in a conventional manner. However, the slab may also be subjected to hot rolling directly after casting, without being subjected to heating. In the case of a thin slab, it may be subjected to hot rolling or proceed to the subsequent step, omitting hot rolling. Further, the hot rolled sheet is optionally subjected to hot rolled sheet annealing. A main purpose of the hot rolled sheet annealing is to improve the magnetic properties by dissolving the band texture generated by hot rolling to obtain a primary recrystallization texture of uniformly-sized grains, and thereby further developing a Goss texture during secondary recrystallization annealing. As that moment, to obtain a highly-developed Goss texture in a product sheet, a hot rolled sheet annealing temperature is preferably 800° C. to 1100° C. If a hot rolled sheet annealing temperature is lower than 800° C., there remains a band texture resulting from hot rolling, which makes it difficult to obtain a primary recrystallization texture of uniformly-sized grains and impedes a desired improvement of secondary recrystallization. On the other hand, if a hot rolled sheet annealing temperature exceeds 1100° C., the grain size after the hot rolled sheet annealing coarsens too much, which makes it difficult to obtain a primary recrystallization texture of uniformly-sized grains.

After the hot rolled sheet annealing, the sheet is subjected to cold rolling once, or twice or more with intermediate annealing performed therebetween, followed by decarburization (combined with recrystallization annealing) and application of an annealing separator to the sheet. After application of the annealing separator, the sheet is subjected to final annealing for purposes of secondary recrystallization and formation of a forsterite film (a film composed mainly of $Mg_2SiO_4$). The annealing separator is preferably composed mainly of MgO to form a forsterite film. As used herein, "composed mainly of MgO" implies that any well-known compound for the annealing separator and any property improvement compound other than MgO may also be contained within a range without interfering with the formation of a forsterite film intended by the invention.

After final annealing, it is effective to optionally subject the sheet to flattening annealing to correct the shape thereof. Insulation coating is applied to the surfaces of the steel sheet before or after the flattening annealing. As used herein, this insulation coating means such coating that may apply tension to the steel sheet to reduce iron loss (hereinafter, referred to as tension coating). Tension coating includes inorganic coating containing silica and ceramic coating by physical vapor deposition, chemical vapor deposition, and so on.

We irradiate a surface of the above-mentioned grain oriented electrical steel sheet after the tension coating with an electron beam or continuous laser, and thereby apply magnetic domain refinement to the grain oriented electrical steel sheet.

EXAMPLES

Example 1

Cold-rolled sheets containing 3 mass % of Si, each of which had been rolled to a final sheet thickness of 0.23 mm, were subjected to decarburization/primary recrystallization annealing. Then, an annealing separator composed mainly of MgO was applied to each sheet. Subsequently, each sheet was subjected to final annealing including a secondary recrystallization process and a purification process, whereby a grain oriented electrical steel sheet having a forsterite film was obtained. At this moment, the value of magnetic flux density $B_8$ was changed in the range of 1.90 to 1.95 T, while changing additives to be added to the annealing separator for use in secondary recrystallization annealing.

Then, a coating composed of 50% colloidal silica and magnesium phosphate was applied to each steel sheet, which in turn was baked at 850° C. to form tension coating.

Thereafter, each steel sheet was placed in a vacuum chamber at 0.1 Pa, where one side of the steel sheet was irradiated with electron beam in a direction perpendicular to the rolling direction, while keeping the acceleration voltage constant at 40 kV and changing the beam current in the range of 1 to 10 mA. With respect to the steel sheet before and after the electron beam irradiation, the magnetic domains on the treated surface and the untreated surface were observed by the Bitter method to measure an average magnetic domain width as well as average widths of magnetic domain discontinuous portions on the treated surface and the untreated surface. The results of observing the magnetic domains in the surfaces of the steel sheet are schematically shown in FIG. 1. In addition, with respect to trace of irradiation, optical microscope observation was carried out to determine whether the base iron was exposed due to impairment of the insulation coating film.

Each of the resulting samples was sheared into pieces of material having bevel edge, each based on a trapezoidal shape with width=100 mm, short side=300 mm and long side=500 mm, and the resulting trapezoidal pieces were laminated into a three-phase transformer weighing about 21 kg. The lamination method was as follows: sets of two sheets were laminated in five steps using a step-lap joint scheme. A capacitor microphone was used to measure the noise of each transformer when excited at 1.7 T and 50 Hz. As frequency weighting, A-scale frequency weighting was performed.

The measured transformer noise is summarized in Table 1, along with the magnetic flux density $B_8$, the absence or presence of trace of irradiation and other parameters of the magnetic domain structure of each steel sheet. In this case, transformer noise of 40.0 dBA or less may be considered as low noise.

TABLE 1

| ID | $B_8$ (T) | Trace of Irradiation | Ave. Magnetic Domain Width Before Treatment $W_0$ (mm) | Ave. Magnetic Domain Width After Treatment (mm) Treated Surface $W_a$ | Ave. Magnetic Domain Width After Treatment (mm) Untreated Surface $W_b$ | Ratio of After to Before Treatment $W_a/W_0$ | Ratio Between Both Sides $W_a/W_b$ | Ave. Width of Magnetic Domain Discontinuous Portions After Treatment (mm) Treated Surface $W_c$ | Ave. Width of Magnetic Domain Discontinuous Portions After Treatment (mm) Untreated Surface $W_d$ | Ratio Between Both Sides $W_d/W_c$ | Transformer Noise (dBA) | Remarks |
|---|---|---|---|---|---|---|---|---|---|---|---|---|
| 1 | 1.911 | none | 1.40 | 0.30 | 0.35 | 0.21 | 0.86 | 0.32 | 0.36 | 1.13 | 44.9 | Comparative Example |
| 2 | 1.913 | none | 1.80 | 0.32 | 0.37 | 0.18 | 0.86 | 0.23 | 0.25 | 1.09 | 39.5 | Inventive Example |
| 3 | 1.944 | present | 1.84 | 0.30 | 0.33 | 0.16 | 0.91 | 0.39 | 0.50 | 1.28 | 43.5 | Comparative Example |
| 4 | 1.930 | none | 1.59 | 0.90 | 1.33 | 0.57 | 0.68 | 0.15 | 0.10 | 0.67 | 44.5 | Comparative Example |
| 5 | 1.935 | none | 1.78 | 0.78 | 0.90 | 0.44 | 0.87 | 0.18 | 0.11 | 0.61 | 44.3 | Comparative Example |
| 6 | 1.944 | none | 1.83 | 0.33 | 0.35 | 0.18 | 0.94 | 0.25 | 0.30 | 1.20 | 39.1 | Inventive Example |

TABLE 1-continued

| ID | $B_8$ (T) | Trace of Irradiation | Ave. Magnetic Domain Width Before Treatment $W_0$ (mm) | Ave. Magnetic Domain Width After Treatment (mm) Treated Surface $W_a$ | Untreated Surface $W_b$ | Ratio of After to Before Treatment $W_a/W_0$ | Ratio Between Both Sides $W_a/W_b$ | Ave. Width of Magnetic Domain Discontinuous Portions After Treatment (mm) Treated Surface $W_c$ | Untreated Surface $W_d$ | Ratio Between Both Sides $W_d/W_c$ | Transformer Noise (dBA) | Remarks |
|---|---|---|---|---|---|---|---|---|---|---|---|---|
| 7 | 1.930 | present | 1.61 | 0.26 | 0.29 | 0.16 | 0.90 | 0.52 | 0.60 | 1.15 | 44.1 | Comparative Example |
| 8 | 1.939 | none | 1.79 | 0.50 | 0.75 | 0.28 | 0.67 | 0.16 | 0.09 | 0.57 | 44.6 | Comparative Example |
| 9 | 1.917 | none | 1.83 | 0.27 | 0.32 | 0.15 | 0.84 | 0.20 | 0.24 | 1.20 | 39.3 | Inventive Example |
| 10 | 1.935 | present | 1.80 | 0.25 | 0.28 | 0.14 | 0.89 | 0.45 | 0.60 | 1.33 | 45.0 | Comparative Example |

As shown in Table 1, our Examples indicated by IDs 2, 6 and 9 have noise values as low as 40.0 dBA or less. In contrast, none of those Comparative Examples has a satisfactory noise value that are outside our range in relation to the irradiation trace, the ratio of the magnetic domain width after the treatment to the magnetic domain width before the treatment, the difference between both sides, and so on. In addition, when $B_8$ is less than 1.92 T (as in ID 1), a satisfactory noise level could not be obtained. It should be noted that the steel sheet samples indicated by IDs 3, 7 and 10, with trace of treatment labeled "present" in Table 1, represent the cases where the condition of electron beam irradiation (in this case, beam current value) was so high that it was beyond a reasonable range.

Example 2

Cold-rolled sheets containing 3 mass % of Si, each of which had been rolled to a final sheet thickness of 0.23 mm, were subjected to decarburization/primary recrystallization annealing. Then, an annealing separator composed mainly of MgO was applied to each sheet. Subsequently, each sheet was subjected to final annealing including a secondary recrystallization process and a purification process, whereby a grain oriented electrical steel sheet having a forsterite film was obtained. At that moment, the value of magnetic flux density $B_8$ was changed in the range of 1.91 to 1.94 T, while changing the primary recrystallization annealing temperature. Then, an insulation coating composed of 60% colloidal silica and aluminum phosphate was applied to each steel sheet, which in turn was baked at 800° C. to form tension coating.

Thereafter, one side of each steel sheet was subjected to magnetic domain refinement treatment such that it was irradiated with continuous fiber laser in a direction perpendicular to the rolling direction. At that moment, the power density was modulated and irradiation was performed under different conditions, while changing the duty ratio of the modulation as well as the maximum and minimum power values. With respect to the steel sheet before and after the laser irradiation, the magnetic domains on the treated surface and the untreated surface were observed by the Bitter method to measure an average magnetic domain width and an average width of magnetic domain discontinuous portions on the treated surface and the untreated surface. In addition, with respect to traces of irradiation, optical microscope observation was carried out to determine whether the base iron was exposed due to impairment of the insulation coating film.

Each of the resulting samples was sheared into pieces of material having bevel edge, each based on a trapezoidal shape with width=100 mm, short side=300 mm and long side=500 mm, and the resulting trapezoidal pieces were laminated into a single-phase transformer weighing about 18 kg. The lamination method was as follows: sets of two sheets were laminated using an alternate-lap joint scheme. A capacitor microphone was used to measure the noise of a transformer when excited at 1.7 T and 50 Hz. A-scale frequency weighting was performed as frequency weighting for auditory sensation.

The measured transformer noise is summarized in Table 2, along with the magnetic flux density Bs, the absence or presence of traces of irradiation and other parameters of the magnetic domain structure of each steel sheet. In this case, it is considered that transformer noise of 35.0 dBA or less represents low noise.

TABLE 2

| ID | $B_8$ (T) | Trace of Irradiation | Ave. Magnetic Domain Width Before Treatment $W_0$ (mm) | Ave. Magnetic Domain Width After Treatment (mm) Treated Surface $W_a$ | Untreated Surface $W_b$ | Ratio of After to Before Treatment $W_a/W_0$ | Ratio Between Both Sides $W_a/W_b$ | Ave. Width of Magnetic Domain Discontinuous Portions After Treatment (mm) Treated Surface $W_c$ | Untreated Surface $W_d$ | Ratio Between Both Sides $W_d/W_c$ | Transformer Noise (dBA) | Remarks |
|---|---|---|---|---|---|---|---|---|---|---|---|---|
| 1 | 1.930 | none | 1.56 | 0.32 | 0.41 | 0.21 | 0.78 | 0.52 | 0.22 | 0.42 | 38.5 | Comparative Example |

TABLE 2-continued

| ID | $B_8$ (T) | Trace of Irradiation | Ave. Magnetic Domain Width Before Treatment $W_0$ (mm) | Ave. Magnetic Domain Width After Treatment (mm) Treated Surface $W_a$ | Ave. Magnetic Domain Width After Treatment (mm) Untreated Surface $W_b$ | Ratio of After to Before Treatment $W_a/W_0$ | Ratio Between Both Sides $W_a/W_b$ | Ave. Width of Magnetic Domain Discontinuous Portions After Treatment (mm) Treated Surface $W_c$ | Ave. Width of Magnetic Domain Discontinuous Portions After Treatment (mm) Untreated Surface $W_d$ | Ratio Between Both Sides $W_d/W_c$ | Transformer Noise (dBA) | Remarks |
|---|---|---|---|---|---|---|---|---|---|---|---|---|
| 2 | 1.914 | none | 1.47 | 0.30 | 0.35 | 0.20 | 0.86 | 0.33 | 0.30 | 0.91 | 39.5 | Comparative Example |
| 3 | 1.931 | none | 1.60 | 0.30 | 0.34 | 0.19 | 0.88 | 0.33 | 0.32 | 0.97 | 34.5 | Inventive Example |
| 4 | 1.925 | none | 1.52 | 0.85 | 0.65 | 0.56 | 1.31 | 0.28 | 0.25 | 0.89 | 38.5 | Comparative Example |
| 5 | 1.935 | none | 1.70 | 0.38 | 0.60 | 0.22 | 0.63 | 0.30 | 0.27 | 0.90 | 39.0 | Comparative Example |
| 6 | 1.933 | none | 1.65 | 0.33 | 0.40 | 0.20 | 0.83 | 0.32 | 0.30 | 0.94 | 34.0 | Inventive Example |
| 7 | 1.931 | present | 1.60 | 0.25 | 0.29 | 0.16 | 0.86 | 0.42 | 0.38 | 0.90 | 38.1 | Comparative Example |
| 8 | 1.929 | none | 1.59 | 0.70 | 0.99 | 0.44 | 0.71 | 0.15 | 0.08 | 0.53 | 39.6 | Comparative Example |
| 9 | 1.925 | present | 1.53 | 0.26 | 0.28 | 0.17 | 0.93 | 0.50 | 0.35 | 0.70 | 38.7 | Comparative Example |
| 10 | 1.935 | none | 1.72 | 0.28 | 0.33 | 0.16 | 0.85 | 0.25 | 0.30 | 1.20 | 34.3 | Inventive Example |

As shown in Table 2, our Examples indicated by IDs 3, 6 and 10 have noise values as low as 35.0 dBA or less. In contrast, none of the Comparative Examples had a satisfactory noise value that are outside our range in relation to the trace of irradiation, the ratio of the magnetic domain width after the treatment to the magnetic domain width before the treatment, the difference between both sides, and so on. In addition, when $B_8$ is less than 1.92 T (as in ID 2), a satisfactory noise level could not be obtained. It should be noted that the steel sheet samples indicated by IDs 7 and 9, with trace of treatment labeled "present" in Table 2, represent the cases where the condition of continuous laser irradiation (in this case, power density) was so high that it was beyond a reasonable range.

The invention claimed is:

1. A grain oriented electrical steel sheet with a forsterite film and a tension coating located over the forsterite film, which has a magnetic flux density $B_8$ of 1.92 T or higher and has a magnetic domain structure modified by strain introduction without a trace of treatment, wherein the steel sheet is made from a slab having a chemical composition comprising C: 0.08 mass % or less and Si: 2.0 to 8.0 mass %, a ratio of an average magnetic domain width in a treated surface after strain-introducing treatment $W_a$ to an average magnetic domain width before the strain-introducing treatment $W_0$ is $0<W_a/W_0<0.4$, and a ratio of the average magnetic domain width $W_a$ to an average magnetic domain width in an untreated surface $W_b$ is $W_a/W_b>0.7$, and a ratio of an average width of a magnetic domain discontinuous portion in the untreated surface $W_d$ to an average width of a magnetic domain discontinuous portion in the treated surface resulting from the strain-introducing treatment $W_c$ is $W_d/W_c>0.8$, and 0 mm$<W_c<$0.35 mm.

2. The grain oriented electrical steel sheet according to claim 1, wherein the strain-introducing treatment is electron beam irradiation.

3. The grain oriented electrical steel sheet according to claim 1, wherein the strain-introducing treatment is continuous laser irradiation.

4. The grain oriented electrical steel sheet according to claim 1, wherein the chemical composition further comprises Ni: 0.03 to 1.50 mass %.

5. The grain oriented electrical steel sheet according to claim 1, wherein $W_c$ satisfies: 0.20 mm$\leq W_c<$0.35 mm.

* * * * *